US006770139B2

(12) United States Patent
Platsch

(10) Patent No.: US 6,770,139 B2
(45) Date of Patent: Aug. 3, 2004

(54) DEVICE FOR DUSTING PRODUCTS

(75) Inventor: Hans Georg Platsch, Stuttgart (DE)

(73) Assignee: Platsch GmbH & Co. KG (DE)

( * ) Notice: Subject to any disclaimer, the term of this patent is extended or adjusted under 35 U.S.C. 154(b) by 0 days.

(21) Appl. No.: 10/034,595

(22) Filed: Dec. 28, 2001

(65) Prior Publication Data

US 2002/0083894 A1 Jul. 4, 2002

(30) Foreign Application Priority Data

Dec. 29, 2000 (DE) ..... 100 65 265

(51) Int. Cl.[7] ..... B05C 19/00

(52) U.S. Cl. ..... 118/308; 118/309; 118/602; 55/301

(58) Field of Search ..... 118/324, 308, 118/309, 504, 326, DIG. 7, 312, 63, 70–71, 602; 55/301–304; 101/424.2; 454/50

(56) References Cited

U.S. PATENT DOCUMENTS 3,814,002 A * 6/1974 Rombach et al. ..... 118/309
4,394,146 A * 7/1983 Klein ..... 55/354
5,279,631 A * 1/1994 Pingel ..... 118/326
6,261,979 B1 * 7/2001 Tanaka et al. ..... 442/370

* cited by examiner

*Primary Examiner*—Richard Crispino
*Assistant Examiner*—Yewebdar Tadesse
(74) *Attorney, Agent, or Firm*—Factor & Lake

(57) ABSTRACT

A dusting device comprises a housing (12) and at least one powder gas delivery device (14, 15), which discharges a powder gas jet (16) onto a surface of products transported in one conveyor direction (18) and a suction device (34) for unused powder gas. At least one housing wall (21) is permeable for an airstream (28*a*), whereby at least one permeable housing wall (21) has an air-permeable filter mat arrangement (22).

24 Claims, 3 Drawing Sheets

DEVICE FOR DUSTING PRODUCTS

BACKGROUND OF THE INVENTION

The present invention relates to dusting devices, in particular dusting devices for dusting products.

The dusting of products to obtain a desired surface quality by means of a powder gas is known (see for example DE 38 19 203 A1). Through such dusting for example the surface of freshly printed products is prepared, so that they do not stick together when stacked. A further application is dusting of rubber as well as glass (the latter in particular in the production of laminated sheets).

A problem when dusting products is excess, unused powder. In order to carry it away the dusting devices generally have a suction device. This however cannot prevent powder adhering to the walls and top of a housing, which surrounds powder discharge nozzles. The dusting powder adhering to the walls and top can fall down in the form of clumps or flakes and fall onto the product being dusted and contaminate this as a result.

In order to overcome this problem today microporous plates are used for the walls and top of dusting devices, whereby the microporous plates are fed with compressed air from compressed air chambers on their outer side. In this way air at low speed continually escapes from the surfaces of the microporous walls, which prevents powder particles settling on the walls (see DE 196 48 227 A1).

These microporous walls fulfil their purpose satisfactorily, but consist of a special sintered plastic, which is very expensive.

SUMMARY OF THE INVENTION

An object of the invention is to find an economic solution to keep the powder away from the housing walls.

According to the present invention there is provided, a dusting device comprising:

a housing;

at least one powder gas delivery device which discharges a powder gas jet onto a surface of products moved in one conveyor direction; and a suction device for unused powder gas, whereby at least one housing wall is permeable for an airstream;

in which at least one permeable housing wall has an air-permeable filter mat arrangement.

It has been found that air-permeable filter mats, which are considerably cheaper than the state of the art microporous plates, very satisfactorily fulfil the purpose of keeping powder away from the surface of the wall formed by them.

A further advantage in contrast to a dusting device with microporous plates consists in the fact that feeding with compressed air and the technical measures associated with this are not necessary, but that a normal fan is sufficient to move air through the filter mats.

If the product width in the transverse direction is great relative to the conveying direction, a number of fans can be used.

If only one wall or top of the device housing has filter mats, the airstream discharged by this preferably flows mainly parallel to the powder gas jet. Therefore powder rising to the top is effectively moved downwards or to the open end of the device housing and therefore into the vicinity of the suction device.

The filter mats are preferably held by mat holders formed as a grid. Thus as little space as possible is taken up by the mat holder so that a homogeneous airstream is produced.

It is advantageous if the permeable filter mats used according to the invention are fitted in the device so that they can be replaced, for example by removing them from the mat holders and replacing them with new ones. As a result it is possible, in the event of the pores of the filter mats possibly becoming blocked and the impaired function associated with this, to quickly take remedial action.

Therefore it is also preferable if the filter mat arrangement used according to the invention with individual walls includes a number of filter mats arranged directly next to each other so that replacement is easier.

Preferably the filter mats consist of a polyester material, more precisely polyester fibre. This material is very tough, for example moisture-proof to approx. 100% relative air humidity and temperature resistant to approx. 100° C. The fibres are unbreakable and can to a certain extent be regenerated (beating, washing the filter mats is possible).

Preferred filter mats have a material thickness of 10–30 mm, preferably 15–20 mm, a weight per m2 of 150–200 g, preferably 180 g, and an initial pressure differential of 25–45 Pa, preferably 30–40 Pa and in particular approx. 33 Pa.

It is most preferable if the upper or top-housing wall and two lateral or even all four lateral housing walls in each case have a filter mat arrangement.

In this case all housing walls, which include a filter mat arrangement, are surrounded by a single interconnected or several separate air chambers.

Suction devices are preferably arranged on the lower end of the two longer lateral housing walls or those transversal to the product conveyor direction along the whole length of the walls. This enables excess powder to be efficiently sucked up.

Especially in the case where the lateral walls do not include a filter mat arrangement the suction device has a powder trapping wall, which can possibly collect powder falling from the lateral walls.

The suction device comprises a suction aperture, the size of which can be adjusted with a slide. Therefore the suction can be adapted to the dusting powder.

The air which is moved through the filter mat arrangement is preferably cleaned by a filter in order to prevent the filter mats being blocked from the rear.

BRIEF DESCRIPTION OF THE DRAWINGS

An embodiment of the present invention is explained, by way of example only, with reference to the following drawings, in which.

DESCRIPTION OF THE PREFERRED EMBODIMENT

Figure 1:
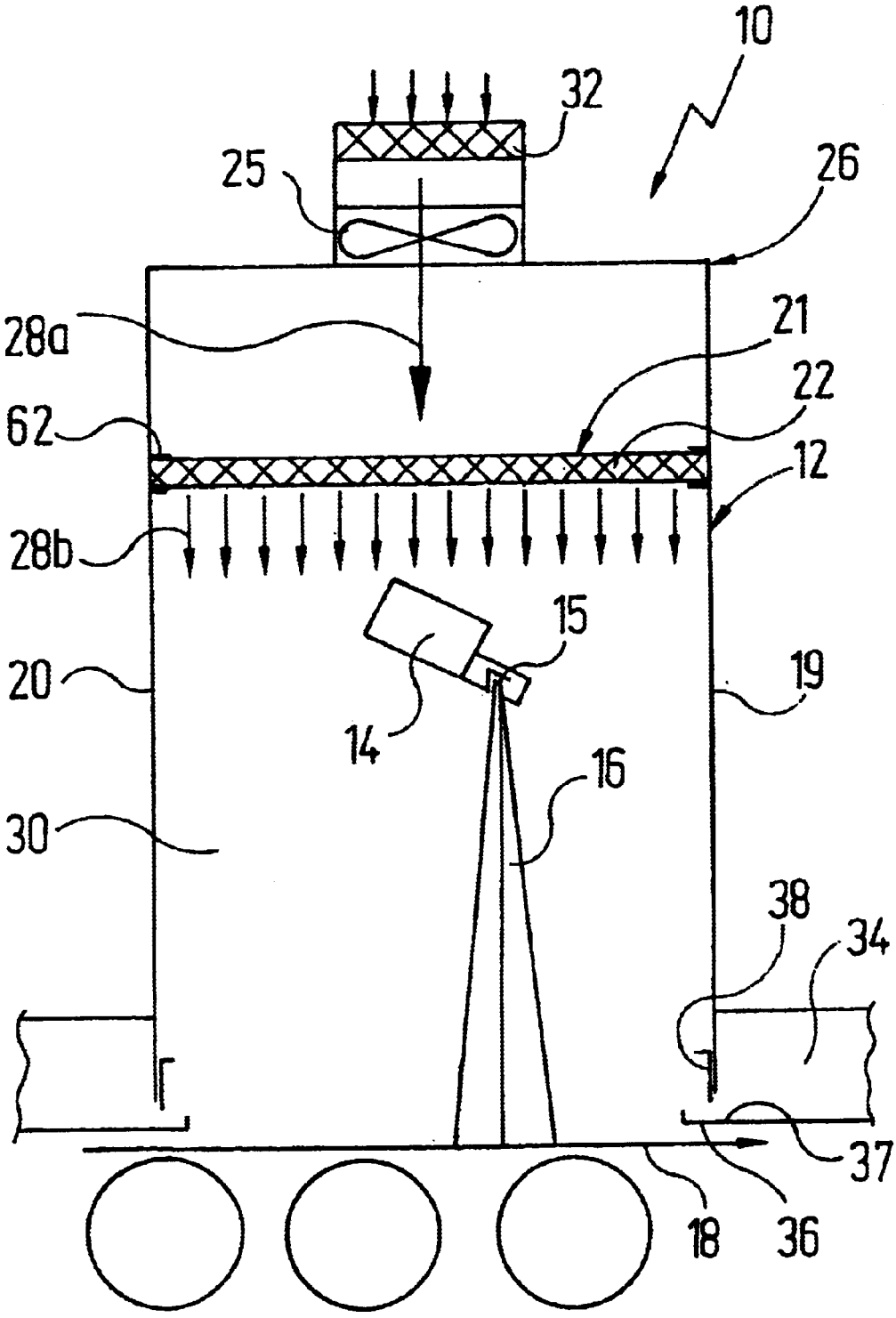
FIG. 1 shows a dusting device in which the top wall of the housing of the device includes a filter mat arrangement.

In FIG. 1, 10 represents a dusting device. It comprises a housing 12 with walls 19, 20 and 21. Inside the housing 30 there is a powder distribution strip 14 for powder gas, which communicates with nozzles 15 at a regular distance in the longitudinal direction of the strip. These produce a curtain-like powder gas jet 16, which is directed onto the surface of a product 18 being dusted. The discharge strip 14 runs vertically to the plane of projection and holds the nozzles 15 at a distance of approx. 10 to 20 cm, so that the powder jets discharged by the individual nozzles overlap.

The top wall 21 of the housing 12 has a filter mat arrangement 22. This is fed with air from several fans 25 arranged behind each other vertically to the plane of projection above a plenum arranged, an air chamber 26 (arrow 28*a*) and discharges an air curtain 28*b* over a wide area. The aspirated air is cleaned by a filter 32.

At the lower end of the lateral walls 19, 20 there is in each case a suction chamber 34, which has a suction slot 37 the size of which can be adjusted by a slide 38. As a result it is possible to regulate the sucking of dusting powder from the inside of the housing. A powder trapping wall 36 hangs over the extension of the lateral walls 19, 20, in order to collect powder from there.

Figure 2:
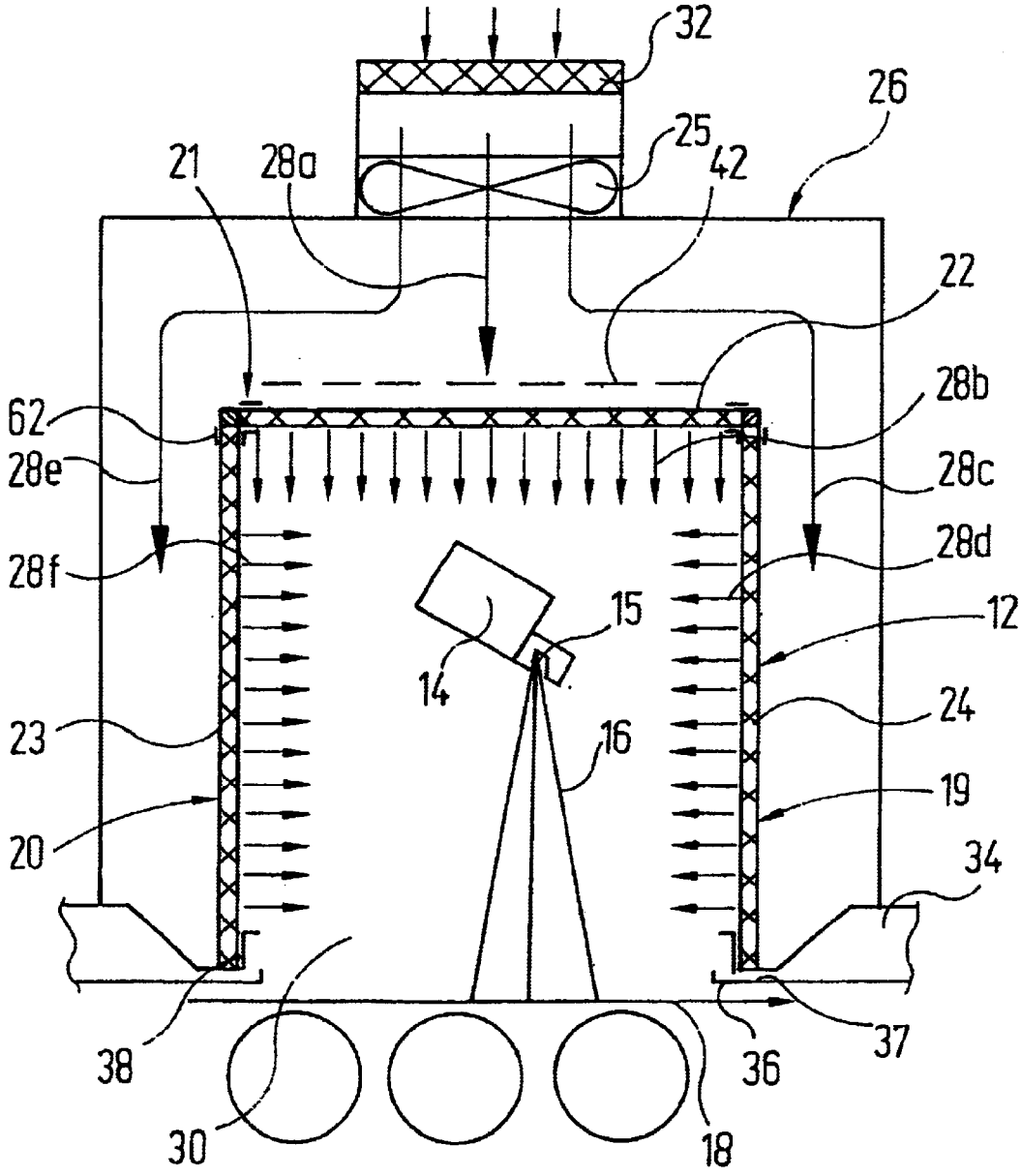
FIG. 2 shows a dusting device, in which the top wall and the transversal vertical walls of the housing of the device include filter mat arrangements.

With the example of embodiment according to FIG. 2 not only the top wall 21 of the housing 12, but also the lateral walls 19, 20 of the housing include filter mat arrangements 22, 23, 24. In this embodiment therefore all housing walls lying above the product conveyor are protected against powder deposits by a wide-area airstream escaping from them 28*b*, 28*d* or 28*f*.

The lateral walls 19, 20 and the top wall 21 of the housing 12 are surrounded by a plenum arranged, a common air chamber 26. Airstreams 28*a*, 28*c*, 28*e* which then pass through the filter mat arrangements 22, 23, 24 are fed into this again by a set of fans 25 spaced vertically to the plane of projection.

An aperture 42 lying in front of the mat arrangement 22 prevents the air escaping primarily through this directly fed mat arrangement.

The filter 32 and the discharge strip 14, the nozzles 15 and the powder gas jet 16 inside the housing 12 are described as similar to FIG. 1. Also the suction device 34 with aperture 37, slide 38 and powder trapping wall 36 correspond to those in FIG. 1.

Figure 3:
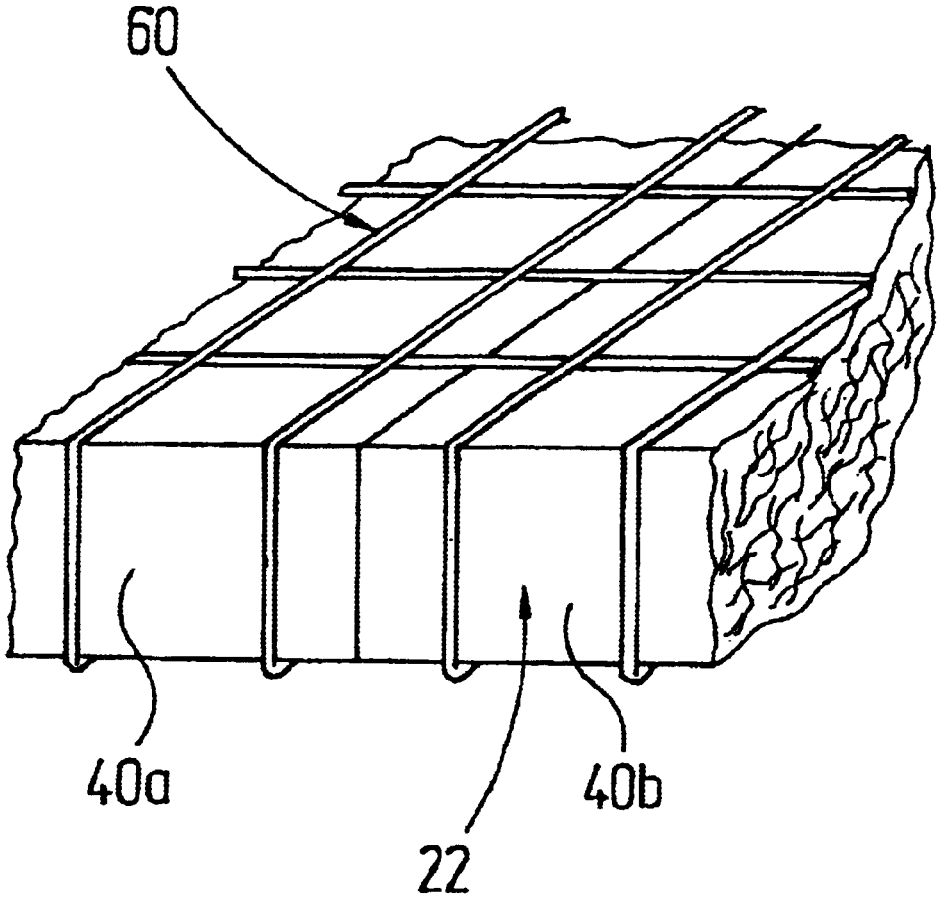
FIG. 3 shows a mat holder formed as a grid, containing two filter mats.

FIG. 3 shows a filter mat arrangement 22, which consists of two filter mats 40*a*, 40*b* arranged directly next to each other. The filter mats are held by a mat holder 60 formed as a grid.

This can be moved in guide rails not shown in more detail in FIG. 3, e.g. the guide rails 62 in FIG. 1 and FIG. 2.

For easier maintenance the housing walls 19, 20, 21 in each case can have two mat holders 60 of half the length which can be moved to one side or the other of the device housing.

I claim:

1. A dusting device comprising:

a housing;

at least one powder gas delivery device within the housing, which discharges a powder gas jet onto a surface of products moved in one conveyor direction;

a suction device for withdrawing unused powder gas from the housing; and at least one air-permeable filter mat arrangement within the housing, and spaced from at least one wall of the housing creating a plenum therebetween;

the plenum being connected to a purging air source providing pressurized purging air.

2. A dusting device according to claim 1, wherein the purging air is moved by means of at least one fan through the filter mat arrangement.

3. A dusting device according to claim 1, wherein several fans are arranged transversally to the conveying direction of the products.

4. A dusting device according to claim 1, wherein the purging air flows mainly parallel to the powder gas jet.

5. A dusting device according to claim 1, wherein the air-permeable filter mat arrangement is held by a mat holder formed as a grid.

6. A dusting device according to claim 1, wherein the air-permeable filter mat arrangement can be replaced.

7. A dusting device according to claim 1, wherein the filter mat arrangement comprises a plurality of filter mats arranged directly next to each other.

8. A dusting device according to claim 1, wherein the filter mat arrangement consists of a polyester material.

9. A dusting device according to claim 8, wherein the filter mat arrangement has a material thickness of 10–30 mm.

10. A dusting device according to claim 9, wherein the filter mat arrangement has a thickness of 15–20 mm.

11. A dusting device according to claim 8, wherein the filter mat arrangement has a weight per $m^2$ of 150–200 g.

12. A dusting device according to claim 11, wherein the fitter mat arrangement has a weight per $m^2$ of 180 g.

13. A dusting device according to claim 8, wherein the filter mat arrangement has an initial pressure differential of 25–45 Pa.

14. A dusting device according to claim 13, wherein the filter mat arrangement has an initial pressure differential of 30–40 Pa.

15. A dusting device according to claim 13, wherein the filter mat arrangement has an initial pressure differential of 33 Pa.

16. A dusting device according to claim 1, wherein the housing comprises an upper and at least two lateral housing walls, and the filter mat arrangement is spaced from each of the upper and at least two lateral walls, and the plenum extends continuously therebetween.

17. A dusting device according to claim 1, wherein at least one housing wall proximate the filter mat arrangement is surrounded by an air chamber.

18. A dusting device according to claim 1, wherein the suction device comprises two suction devices for unused powder gas, which are arranged on the lower end of two housing walls transversal to the product conveyor direction.

19. A dusting device according to claim 1, wherein the suction device comprises at least one powder trapping wall which lies in the extension of a housing wall that is not proximate the filter mat arrangement.

20. A dusting device according to claim 1, wherein the suction device has a suction aperture, which is adjustable with a slide.

21. A dusting device according to claim 3, wherein at least one airfilter is arranged in series to the fans.

22. A dusting device comprising:

a housing;

at least one powder gas delivery device within the housing, which discharges a powder gas jet onto a surface of products moved in one conveyor direction;

a suction device for withdrawing unused powder gas from the housing; and at least one air-permeable filter mat arrangement within the housing, and spaced from at least one wall of the housing creating a plenum therebetween;

the plenum being connected to a purging air source providing pressurized purging air which flows mainly parallel to the powder gas jet.

23. A dusting device comprising:

a housing;

at least one powder gas delivery device within the housing, which discharges a powder gas jet onto a surface of products moved in one conveyor direction;

a suction device for withdrawing unused powder gas from the housing; and at least one air-permeable filter mat arrangement within the housing, and spaced from at least one wall of the housing creating a plenum therebetween, wherein the filter mat arrangement comprises a polyester material;

the plenum being connected to a purging air source providing pressurized purging air.

24. A dusting device comprising:

a housing having an upper and at least two lateral housing walls;

at least one powder gas delivery device within the housing, which discharges a powder gas jet onto a surface of products moved in one conveyor direction;

a suction device for withdrawing unused powder gas from the housing; and at least one air-permeable filter mat arrangement within the housing, and spaced from the upper and at least two lateral walls creating a plenum therebetween;

the plenum being connected to a purging air source providing pressurized purging air.

* * * * *